US008827270B1

(12) United States Patent
Fiore

(10) Patent No.: US 8,827,270 B1
(45) Date of Patent: Sep. 9, 2014

(54) MODULAR GAME BOARD SYSTEM

(71) Applicant: Brian Fiore, Longwood, FL (US)

(72) Inventor: Brian Fiore, Longwood, FL (US)

( * ) Notice: Subject to any disclaimer, the term of this patent is extended or adjusted under 35 U.S.C. 154(b) by 0 days.

(21) Appl. No.: 14/067,645

(22) Filed: Oct. 30, 2013

(51) Int. Cl.
*A63F 3/00* (2006.01)

(52) U.S. Cl.
USPC ..... 273/284; 273/288; 273/287; 273/148 A

(58) Field of Classification Search
USPC ..... 273/284, 287, 288, 150, 148 A
See application file for complete search history.

(56) References Cited

U.S. PATENT DOCUMENTS

| | | | | |
|---|---|---|---|---|
| 2,872,215 | A | 2/1959 | Taylor | |
| 3,069,168 | A * | 12/1962 | Feldman et al. | 273/273 |
| 3,263,999 | A | 8/1966 | McCoy | |
| 3,399,893 | A | 9/1968 | Payne, Jr. | |
| 3,665,618 | A * | 5/1972 | Hahn | 273/270 |
| 3,933,357 | A | 1/1976 | Mercer et al. | |
| 4,016,939 | A | 4/1977 | Thron | |
| 4,141,561 | A | 2/1979 | Spitzner | |
| 4,243,223 | A | 1/1981 | Ver Hoef et al. | |
| 4,508,344 | A | 4/1985 | Krogh | |
| 5,217,225 | A | 6/1993 | Dubarry, Jr. | |
| 5,407,204 | A * | 4/1995 | Meyer, III | 273/244.2 |
| 5,456,472 | A | 10/1995 | Goodman | |
| 5,727,787 | A * | 3/1998 | Salley | 273/284 |
| 6,120,022 | A | 9/2000 | Stokes | |
| 7,467,795 | B2 | 12/2008 | Middleton, Jr. | |
| 8,132,813 | B2 | 3/2012 | Wilkinson et al. | |
| 2004/0080109 | A1 | 4/2004 | Dudar | |
| 2013/0020763 | A1 | 1/2013 | Sullivan | |

FOREIGN PATENT DOCUMENTS

| | | |
|---|---|---|
| WO | WO2005119566 A2 | 12/2005 |
| WO | WO2005119566 A3 | 12/2005 |

* cited by examiner

*Primary Examiner* — Vishu K. Mendiratta

(57) ABSTRACT

A modular game board system includes a game board housing. The game board housing includes a transparent top wall that is configured to allow viewing of a media insert removably positioned in the game board housing. Each of plurality of pawn housings has a front wall, a rear wall and an intermediate wall that is attached to the front and rear walls. The front wall is transparent and each of the pawn housings has an opening therein configured for slidably receiving a media insert. A plurality of bases is provided and each of the pawn housings has one of the bases attached thereto. The media inserts may be removed and replaced to alter game play.

12 Claims, 3 Drawing Sheets

MODULAR GAME BOARD SYSTEM

BACKGROUND OF THE DISCLOSURE

Field of the Disclosure

The disclosure relates to modifiable game board systems and more particularly pertains to a new system for allowing a person to modify all portions of a game for altering game play in an unlimited fashion.

SUMMARY OF THE DISCLOSURE

An embodiment of the disclosure meets the needs presented above by generally comprising a game board housing. The game board housing includes a transparent top wall that is configured to allow viewing of a media insert removably positioned in the game board housing. Each of plurality of pawn housings has a front wall, a rear wall and in intermediate wall that is attached to the front and rear walls. The front wall is transparent and each of the pawn housings has an opening therein configured for slidably receiving a media insert. A plurality of bases is provided and each of the pawn housings has one of the bases attached thereto. The media inserts may be removed and replaced to alter game play.

An embodiment of the disclosure further generally comprises a plurality of game board tiles each having a transparent top wall. The game board tiles are each configured to receive a separate media insert and are then positionable adjacent to each other to form a game board surface. A plurality of pawn housings is provided. Each of the pawn housings has a front wall, a rear wall and an intermediate wall attached to the front and rear walls. The front wall is transparent and each of the pawn housings has an opening therein configured for slidably receiving a media insert. Each of the pawn housings has one of a plurality of bases attached thereto. The media inserts may be removed and replaced to alter game play.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
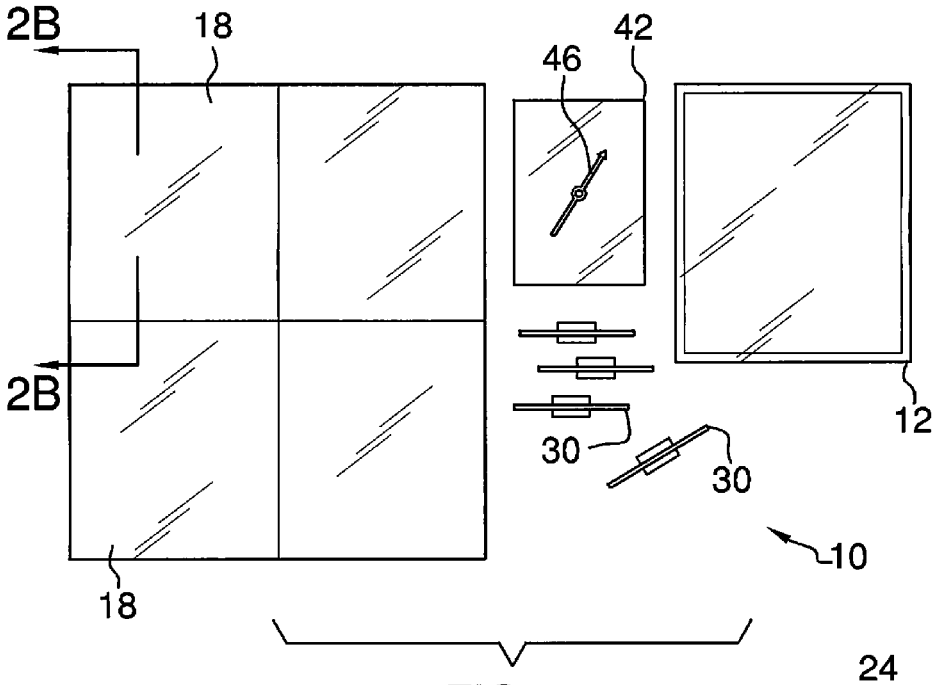
FIG. 1 is a top view of a modular game board system according to an embodiment of the disclosure.
Figure 2A:
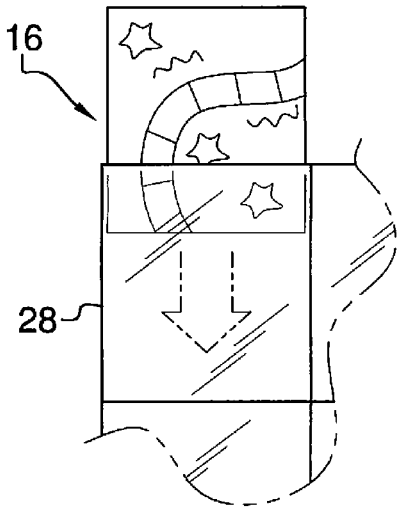
FIG. 2A is a broken top view of an embodiment of the disclosure.
Figure 2B:
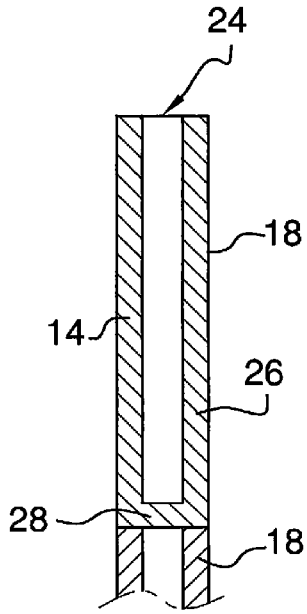
FIG. 2B is a cross-sectional view of an embodiment of the disclosure taken along line 2B of FIG. 1.
Figure 3:
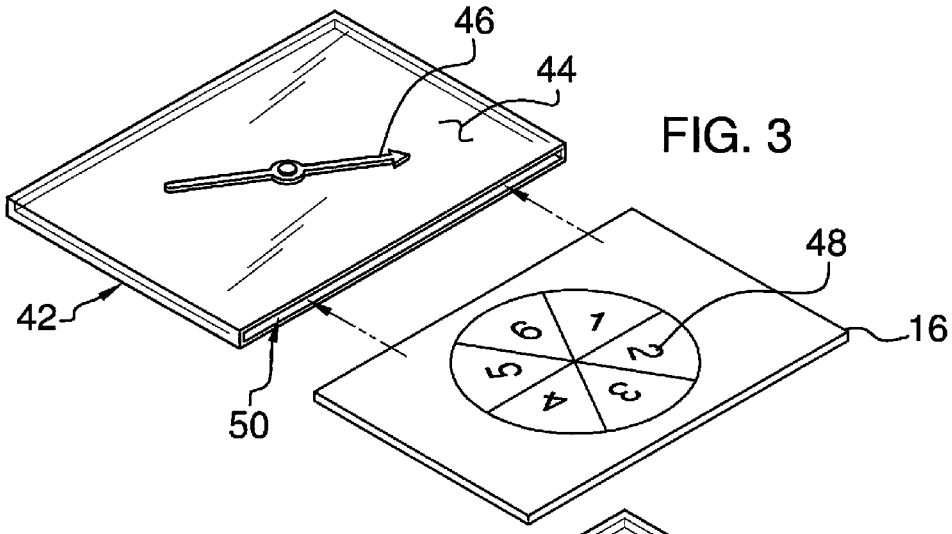
FIG. 3 is a top perspective view of a spinner housing of an embodiment of the disclosure.

With reference now to the drawings, and in particular to FIGS. 1 through 6 thereof, a new modifiable game board system embodying the principles and concepts of an embodiment of the disclosure and generally designated by the reference numeral 10 will be described.

As best illustrated in FIGS. 1 through 6, the modular game board system 10 generally comprises a game board housing 12. The game board housing 12 includes a transparent top wall 14 that is configured to allow viewing of a media insert 16 removably positioned in the game board housing 12. The game board housing 12 may comprise a single game board housing 12 or may comprise a plurality of game board tiles 18. Alternatively, a game board housing 12 may be provided along with a plurality of game board tiles 18 as shown in FIG. 1. This allows the game board housing 12 to function as a container for holding all components of the system 10 and/or to function as part of a game being played.

Figure 4:
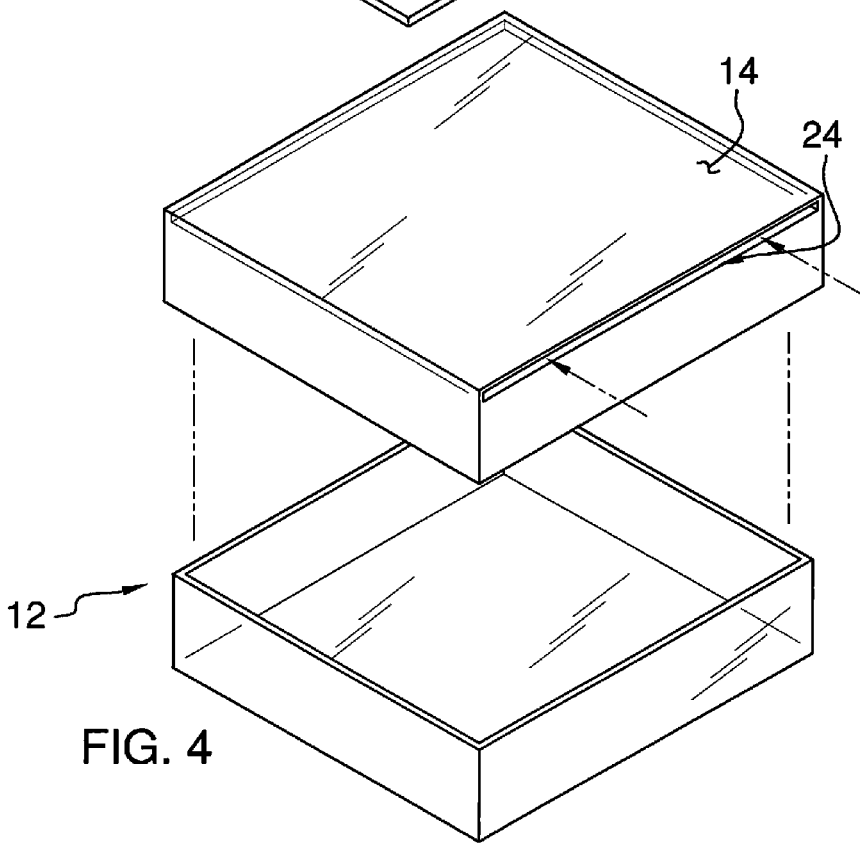
FIG. 4 is a top perspective view of game board housing of an embodiment of the disclosure.
Figure 5:
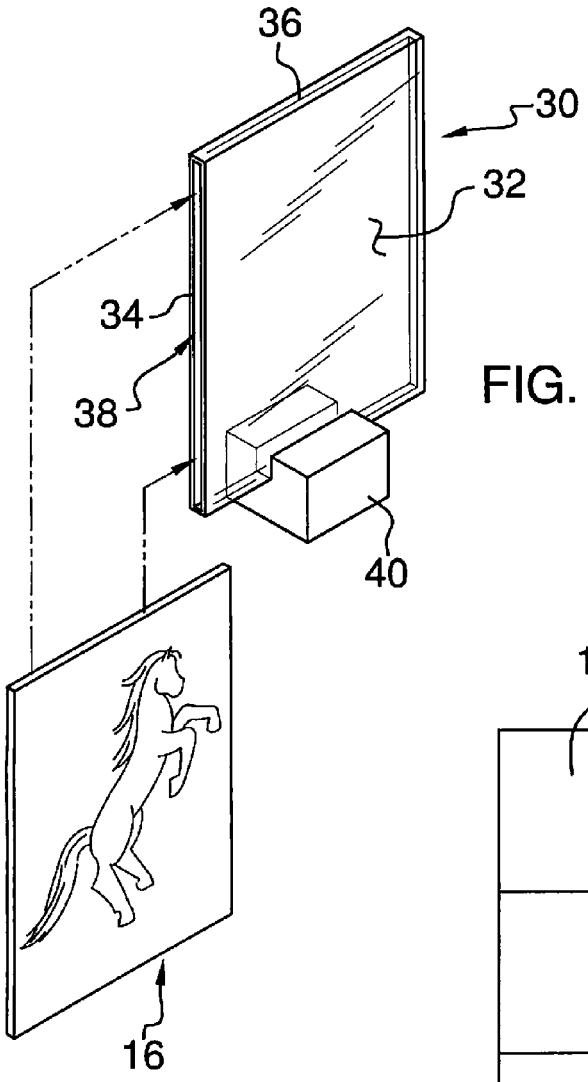
FIG. 5 is a front perspective view of a pawn housing of an embodiment of the disclosure.
Figure 6:
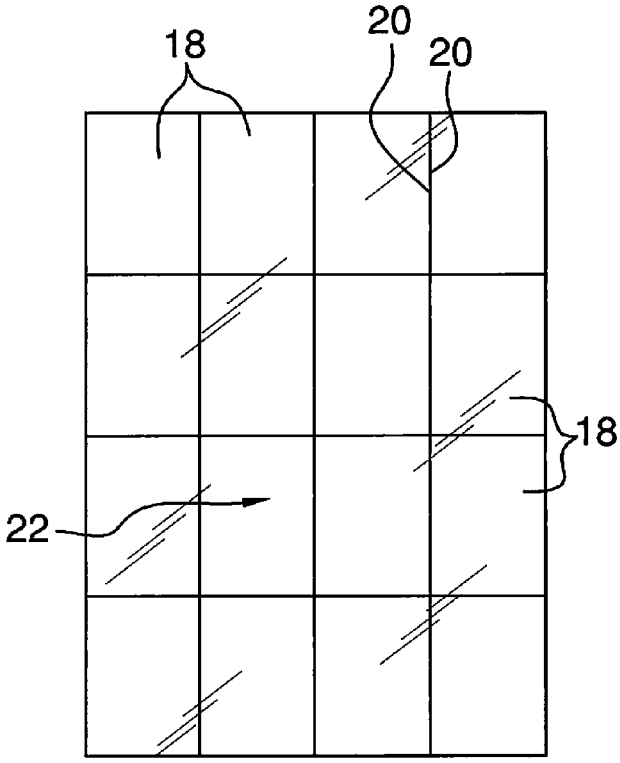
FIG. 6 is a top view of game board tiles an embodiment of the disclosure.

If a plurality of game board tiles 18 is utilized, each of the game board tiles 18 will be configured to each receive separate media insert 16. The game board tiles 18 are positionable adjacent to each other to form a game board surface 22, such as is shown in FIG. 6. Though not shown, the game board tiles 18 may include interlocking edges 20 to releasably secure the game board tiles 18 together. The media insert 16, or inserts, are slid into a slot 24 positioned within the game board tiles 18. As shown in FIG. 4, the game board housing 12 may also include a slot 24 positioned within the top wall 14 for receiving the media insert 16 or the media insert 16 may be positioned within the housing 12 between the top 14 and bottom 24 walls so that the media insert 16 is viewable through the top wall 14. The positioning of the media insert 16 ensures that that the media insert 16 is clearly visible through the top wall 14. Though shown as a shallow area within the top wall 14 for receiving the media insert 16, it should be understood that this area may have a greater height to function as an auxiliary housing positioned over a main body of the game board housing 12. If the game board housing 12 is used as a single media insert receiving member, the game board housing 12 will have its top wall 14 likely having a length and width each greater than 12.0 inches. However, it should be understood that a miniature embodiment of the system 10 may be contemplated having a smaller size than indicated above. The game board housing 12 may store various game playing articles when not in use. The game board tiles 18, when each filled with a media insert 16, are positioned so that the media inserts 16 form a discernable game board surface for playing a game.

The game board tiles 18 may each comprise the top wall 14, a bottom wall 26 and a perimeter edge 28 with the slot 24 therein for receiving media insert 16. The game board tiles 18 may include a generally rigid plastic or glass material, or a thin, flexible plastic material. Alternatively, the game board tiles 18 may include a folder type construction of a pair of flexible panels between which a media insert 16 may be positioned. Yet another construction may include board tiles 18 comprised of hinged cases which may be snapped closed. In general, the important factor of the game board tiles 18, or game housing 12 should the game board tiles 18 not be used, is that the top wall 14 is transparent to allow the media insert 16 to be easily viewed and which also allows the media insert 16 to be removed and replaced as needed. It is further comprehended that the board tiles 18, while shown with a rectangular shape, may be provided in other geometric shapes such as triangles, pentagons, hexagons and the like.

A plurality of pawn housings 30 is provided. The pawn housings 30, generally, are to be used as game pieces for moving along the game board surface 22. Each of the pawn housings 30 has a front wall 32, a rear wall 34 and an intermediate wall 36 that is attached to the front 32 and rear 34 walls. The front wall 32 is transparent, though the entire pawn housing 30 may be transparent. Each of the pawn housings 30 has an opening 38 therein configured for slidably receiving a media insert 16. The slots 24 and openings 38 may be positioned along any edge of the game board tiles 18 or pawn housings 30. As with the game board tiles 18, the pawn housings 30 may comprise rigid transparent materials, cases, or flexible sleeves and folders. While the media inserts 16 of the game board tiles 18, and or game board housing 12, comprise game board surface indicia, those inserted into the pawn housings 30 will include indicia representing game pieces that are moved along game paths on the game board tiles 18. The pawn housings 30 may have a rectangular shape as shown, though such is not necessary. Generally, each of the pawn housings 30 will have a smaller size than a size of game board tiles 18. That is, a surface area of the front walls 32 will typically be smaller than surface area of the top walls 14 of the game tiles 18. More particularly, the front walls 32 of the pawn housings 30 will be less than 10.0 $in^2$, though larger pawn housings 30 may be contemplated.

A plurality of bases 40 may be provided and each of the pawn housings 30 has one of the bases 40 attached thereto. The bases 40 vertically orientate the front walls 32 when a bottom surface of the bases 40 is placed on the game board housing 12 or game board tiles 18. Alternatively, the bases 40 may be positioned on the rear wall 34 such that the front wall 32 faces upwardly and is horizontally oriented.

A spinner housing 42 includes a horizontally oriented upper wall 44 and a spinner 46 is rotatably coupled to the upper wall 44. The upper wall 44 is transparent and the spinner housing 42 has an aperture 50 therein configured to removably receive a media insert 16 having spinner indicia thereon 48. The spinner indicia 48 are defined as any configuration of numbers, words or markings which a player of a game using the system 10 requires for particular movement configurations and/or other game mechanics and can be configured to emulate other types of chance means such as dice. Thus the spinner indicia 48 may include numbering such as 1 through 6 and up to 1 through 20, for instance. The spinner housing 42 allows the user of the system 10 to thereby change the spinner, which is being used as a chance means, to fit the particular game requirements of the game being used with the spinner 46. It should be understood that various components of the system 10, such as in particular the spinner housing 42, may be provided individually to modify existing or contemplated games.

In use, the media inserts 16 may be removed and replaced to alter game play. For example, a game developer would develop a game using different media inserts 16 that can be inserted into the pawn housings 30, game board tiles 18 and spinner housing 42. The user of the system 10 would then use the media inserts 16 to set up the game board tiles 18 as needed to form a game board surface 22 on which to move the pawn housings 30. The spinner 46 would also be used to determine movement of the pawns housings 30 or other game pieces supplied by the game developer. It should be understood that the developer may include additional game elements such as playing cards, playing pieces, additional chance means and the like. However, the system 10 provides the ability of a game developer to easily and cost effectively develop a new game as the cost of making game boards, pawns and chance means can be prohibitively expensive, particularly when done in small batches, as opposed to simply creating paper or laminated media inserts. For game players, the system 10 allows for interchangeability to keep the overall cost of multiple games down as well as providing game players with the ability to further modify games as they see fit.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A modular gaming system configured to facilitate modification of an appearance of portions of a game, said system including:

a game board housing, said game board housing including a transparent top wall being configured to allow viewing of a media insert removably positioned in said game board housing;

a plurality of pawn housings, each of said pawn housings having a front wall, a rear wall and an intermediate wall being attached to said front and rear walls, said front wall being transparent, each of said pawn housings having an opening therein configured for slidably receiving a media insert;

a plurality of bases, each of said pawn housings having one of said bases attached thereto; and wherein said media inserts may be removed and replaced to alter game play.

2. The modular gaming system according to claim 1, wherein said game board housing includes a plurality of game board tiles, each of said game board tiles being configured to receive separate media insert, said game board tiles being positionable adjacent to each other to form a game board surface.

3. The modular gaming system according to claim 2, wherein each of said pawn housings has a smaller size than a size of game board tiles.

4. The modular gaming system according to claim 1, wherein said bases vertically orient said front walls when a bottom surface of said bases is placed on said game board housing.

5. The modular gaming system according to claim 1, further including a spinner housing including a horizontally oriented upper wall and a spinner being rotatably coupled to said upper wall, said upper wall being transparent, wherein said spinner housing is configured to removably receive a media insert having spinner indicia thereon.

6. The modular gaming system according to claim 2, further including a spinner housing including a horizontally oriented upper wall and a spinner being rotatably coupled to said upper wall, said upper wall being transparent, wherein said spinner housing is configured to removably receive a media insert having spinner indicia thereon.

7. A modular gaming system configured to facilitate modification of an appearance of portions of a game, said system including:

a game board housing, said game board housing including a transparent top wall being configured to allow viewing of a media insert removably positioned in said game board housing, said game board housing including a plurality of game board tiles, each of said game board tiles being configured to receive separate media insert, said game board tiles being positionable adjacent to each other to form a game board surface;

a plurality of pawn housings, each of said pawn housings having a front wall, a rear wall and an intermediate wall being attached to said front and rear walls, said front wall being transparent, each of said pawn housings having an opening therein configured for slidably receiving a media insert, each of said pawn housings having a smaller size than a size of game board tiles;

a plurality of bases, each of said pawn housings having one of said bases attached thereto, said bases vertically orienting said front walls when a bottom surface of said bases is placed on said game board housing;

a spinner housing including a horizontally oriented upper wall and a spinner being rotatably coupled to said upper wall, said upper wall being transparent, wherein said spinner housing is configured to removably receive a media insert having spinner indicia thereon; and wherein said media inserts may be removed and replaced to alter game play.

8. A modular gaming system configured to facilitate modification of an appearance of portions of a game, said system including:

a plurality of game board tiles, each having a transparent top wall, each game board tile being configured to receive a separate media insert, said game board tiles being positionable adjacent to each other to form a game board surface;

a plurality of pawn housings, each of said pawn housings having a front wall, a rear wall and an intermediate wall being attached to said front and rear walls, said front wall being transparent, each of said pawn housings having an opening therein configured for slidably receiving a media insert;

a plurality of bases, each of said pawn housings having one of said bases attached thereto; and wherein said media inserts may be removed and replaced to alter game play.

9. The modular gaming system according to claim 8, wherein each of said pawn housings has a smaller size than a size of game board tiles.

10. The modular gaming system according to claim 8, wherein said bases vertically orient said front walls when a bottom surface of said bases is placed on said game board housing.

11. The modular gaming system according to claim 8, further including a spinner housing including a horizontally oriented upper wall and a spinner being rotatably coupled to said upper wall, said upper wall being transparent, wherein said spinner housing is configured to removably receive a media insert having spinner indicia thereon.

12. The modular gaming system according to claim 9, further including a spinner housing including a horizontally oriented upper wall and a spinner being rotatably coupled to said upper wall, said upper wall being transparent, wherein said spinner housing is configured to removably receive a media insert having spinner indicia thereon.

* * * * *